United States Patent [19]

de Buzzaccarini

[11] Patent Number: 4,767,563

[45] Date of Patent: Aug. 30, 1988

[54] LIQUID SCOURING CLEANSERS CONTAINING SOLVENT SYSTEM

[75] Inventor: Francesco de Buzzaccarini, Brussels, Belgium

[73] Assignee: The Procter & Gamble Company, Cincinnati, Ohio

[21] Appl. No.: 35,204

[22] Filed: Apr. 6, 1987

Related U.S. Application Data

[63] Continuation of Ser. No. 769,811, Aug. 23, 1985, abandoned, which is a continuation of Ser. No. 595,794, Apr. 2, 1984, abandoned.

[30] Foreign Application Priority Data

Apr. 19, 1983 [GB] United Kingdom ..... 8310538
Sep. 20, 1983 [GB] United Kingdom ..... 8325162

[51] Int. Cl.[4] ..... C11D 15/00
[52] U.S. Cl. ..... 252/174.25; 252/135; 252/179; 252/539; 252/540; 252/558; 252/559
[58] Field of Search ..... 252/153, 154, 174.15, 252/112, 115, 123, 154, 174.25, 135, 179, 539, 540, 549, 558, 559

[56] References Cited

U.S. PATENT DOCUMENTS

| | | | |
|---|---|---|---|
| 1,515,950 | 11/1924 | Hildenbrand | 252/119 |
| 1,885,133 | 11/1932 | Oppenheimer | 252/154 |
| 2,257,186 | 9/1941 | Orthmer | 252/154 |
| 3,956,158 | 5/1976 | Donaldson | 252/DIG. 4 |
| 4,129,527 | 12/1978 | Clark et al. | 252/547 |
| 4,414,128 | 11/1983 | Goffinet | 252/111 |
| 4,457,856 | 7/1984 | Mitchell et al. | 252/166 |
| 4,615,821 | 10/1986 | Siklosi | 252/174.25 |

FOREIGN PATENT DOCUMENTS 0040882 2/1981 European Pat. Off. .

*Primary Examiner*—Paul Lieberman
*Assistant Examiner*—John F. McNally
*Attorney, Agent, or Firm*—Leonard Williamson; Richard C. Witte

[57] ABSTRACT

Liquid compositions, particularly for use as hard surface cleaners, comprise terpenes, benzyl alcohol and abrasives. The compositions provide excellent cleaning of both greasy and particulate soils from hard surfaces without streaking or filming, excellent formulation homogeneity, stability and viscosity characteristics, as well as good suds control.

9 Claims, No Drawings

LIQUID SCOURING CLEANSERS CONTAINING SOLVENT SYSTEM

This is a continuation of application Ser. No. 769,811, filed on Aug. 23, 1985; which is a continuation of application Ser. No. 595,794, filed Apr. 2, 1984, both now abandoned.

TECHNICAL FIELD

This invention relates to liquid scouring cleansers. In particular, it relates to aqueous scouring cleansers containing an abrasive and a binary solvent system. These cleansers are suitable for use as general purpose household cleaning compositions.

BACKGROUND

General purpose household cleaning compositions for hard surfaces such as metal, glass, ceramic, plastic and linoleum surfaces, are commercially available in both powdered and liquid form. Powdered cleaning compositions consist mainly of builder or buffering salts such as phosphates, carbonates, silicates, etc., and although such compositions may display good inorganic soil removal, they are generally deficient in cleaning ability on organic soils such as the grease/fatty/oily soils typically found in the domestic environment.

Liquid cleaning compositions, on the other hand, have the great advantage that they can be applied to hard surfaces in neat or concentrated form so that a relatively high level of surfactant material is delivered directly to the soil. Moreover, it is a rather more straightforward task to incorporate high concentrations of anionic or nonionic surfactant in a liquid rather than a granular composition. For both these reasons, therefore, liquid cleaning compositions have the potential to provide superior grease and oily soil removal over powdered cleaning compositions.

Nevertheless, liquid cleaning compositions still suffer a number of drawbacks which can limit their consumer acceptability. Thus, they generally contain little or no detergency builder salts and consequently they tend to have poor cleaning performance on particulate soil and also lack "robustness" under varying water hardness levels. In addition, they can suffer problems of product form, in particular, inhomogeneity, lack of clarity, or inadequate viscosity characteristics for consumer use. Moreover, the higher in-product and in-use surfactant concentration necessary for improved grease handling raises problems of extensive suds formation requiring frequent rinsing and wiping on behalf of the consumer. Although oversudsing may be controlled to some extent by incorporating a suds-regulating material such as hydrophobic silica and/or silicone or soap, this in itself can raise problems of poor product stability and homogeneity and also problems associated with deposition of insoluble particulate or soap residues on the items or surfaces being cleaned, leading to filming, streaking and spotting.

Importantly, liquid cleansers suffer from the disadvantage that, in the main, they do not contain abrasives, which contribute substantially to the cleaning performance of many dry-powder household and industrial cleaning compositions.

It has now been discovered, however, that these defects of prior art liquid cleaning composition can be minimized or overcome through the incorporation therein of a specified mono- or sesquiterpene material, in combination with benzyl alcohol, and with an abrasive. Although the terpenes, as a class, have limited water-solubility, it has been found that they can be incorporated into liquid cleaning compositions in homogeneous form, even under "cold" processing conditions, with the ability to provide excellent cleaning characteristics across the range of water hardness on grease/oily soils and inorganic particulate soils, as well as on shoe polish, marker ink, bath tub soil etc, and excellent shine performance with low soil redeposition and little or no propensity to cause filming, streaking or spotting on surfaces washed therewith. Moreover, the terpenes herein specified, and in particular those of the hydrocarbon class, are valuable in regulating the sudsing behavior of the instant compositions in both hard and soft water and under both diluted and neat or concentrated usage, while terpenes of the terpene alcohol class are also valuable for providing effective control of product viscosity characteristics.

Terpenes are, of course, well-known components of perfume compositions and are often incorporated into detergent compositions at low levels via the perfume. Certain terpenes have also been included in detergent compositions at higher levels; for instance, German Patent Application No. 21 13 732 discloses the use of aliphatic and alicyclic terpenes as anti-microbial agents in washing compositions; British Pat. No. 1.308.190 teaches the use of dipentenes in a thixotropic liquid detergent suspension base composition. German Patent Application No. 27 09 690 teaches the use of pine oil (a mixture mainly of terpene alcohols) in liquid hard surface cleaning compositions.

U.S. Pat. No. 4,158,583 teaches a liquid cleanser with abrasives harder than 3 on the Mohs scale.

European Application No. 81-200540.3 teaches the use of terpenes with solvents such as benzyl alcohol and ethylene glycol dibutyl ether in liquid cleanser compositions. European Application No. 82201396.7 teaches the use of terpenes and butyl carbitol (a trademark for 2-(2-butoxyethoxy)ethanol) in a liquid cleanser, optionally with particulate zeolite builders. However, the use of such combinations of terpene/solvent with an abrasive of the type disclosed herein does not appear to have been considered, heretofore.

The present invention provides abrasive-containing liquid cleaning and scouring compositions which have excellent suds control across a broad range of usage and water hardness conditions and which provide excellent shine performance together with improved cleaning characteristics both on greasy/oily soils and on inorganic particulate soils, with little tendency to cause filming or streaking on washed surfaces. Importantly, the abrasives used herein are non-detrimental to surfaces cleansed with the present compositions.

SUMMARY OF THE INVENTION

The compositions herein may be succinctly described as liquid scouring cleansers which comprise at least 0.1% (preferably 0.5–10%) of a terpene or a terpene derivative, or mixtures thereof; at least 0.1% (preferably 0.5–10%) of benzyl alcohol; optionally, and preferably, conventional additives such as detersive surfactants, hydrotropes, detergency builders, water softeners, carrier liquids (especially water), perfumes, and the like, characterized in that the compositions comprise: from 1–50% (preferably 15 to 30%; most preferably 20 to 25%) of a water-insoluble abrasive of the type described hereinafter.

DETAILED DESCRIPTION OF THE INVENTION

The essential terpene, benzyl alcohol, and abrasive, as well as the preferred surfactant components, and other optional ingredients used in the practice of the present invention are described in more detail, hereinafter. All percentages and ratios mentioned in this specification are by weight, unless otherwise stated.

Terpene—Preferred terpenes are mono- and bicyclic monoterpenes, especially those of the hydrocarbon class, which include the terpinenes, terpinolenes, limonenes and pinenes, and mixtures thereof. Highly preferred materials of this type are d-limonene, dipentene, $\alpha$-pinene, $\beta$-pinene and the mixture of terpene hydrocarbons obtained from the essence of oranges (e.g. cold-pressed orange terpenes and orange terpene oil phase ex fruitjuice). These terpenes are used at concentrations of at least 0.1%, preferably 0.5% to 10%, most preferably 2%–6%, in the compositions.

Terpene derivatives such as alcohols, aldehydes, esters, and ketones can optionally be used, but are not as preferred as the terpenes noted above. Such materials are commercially available as, for example, the $\alpha$, $\beta$ and $\gamma$ isomers of terpineol and linalool, and as borneol and geraniol. The terpene derivatives are typically used in the compositions of this invention, at concentrations from about 0.5% to about 10%, more preferably from about 1.5% to about 2.5%.

Benzyl Alcohol—The benzyl alcohol ($C_6H_5CH_2OH$) is used in the compositions at concentrations of at least 0.1%, preferably 0.5–10%, most preferably 1.5–3.5%.

The weight ratio of terpenes to benzyl alcohol is preferably in the range from 5:1 to 1:5, most preferably 2:1 to 1:2.

Abrasive—The abrasives employed herein are selected from water-insoluble, non-gritty materials well-known in the literature for their relatively mild abrasive properties. It is highly preferred that the abrasives used herein not be undesirably "scratchy". Abrasive materials having a Mohs hardness in the range of about 7, or below, are typically used; abrasives having a Mohs hardness of 3, or below, can be used to avoid scratches on aluminum or stainless steel finishes. Suitable abrasives herein include inorganic materials, especially such preferred materials as calcium carbonate and diatomaceous earth, as well as materials such as Fuller's earth, magnesium carbonate, China clay, attapulgite, calcium hydroxyapatite, calcium orthophosphate, dolomite and the like. Organic abrasives such as urea-formaldehyde, methyl methacrylate and melamine-formaldehyde resins can also be used.

It is preferred that the abrasives herein have a particle size range in the 100–600 US Sieve Series Mesh, preferably 200–400 US Sieve Series Mesh, size. Diatomaceous earth and calcium carbonate are commercially available in the 5–150 micron particle size range, and, as will be seen hereinafter, give excellent cleaning performance.

Surfactants—Water-soluble detersive surfactants useful herein include well-known synthetic anionic, nonionic, amphoteric and zwitterionic surfactants. Typical of these are the alkyl benzene sulfates and sulfonates, paraffin sulfonates, olefin sulfonates, alkoxylated (especially ethoxylated) alcohols and alkyl phenols, amine oxides, sulfonates of fatty acids and of fatty acid esters, and the like, which are well-known from the detergency art. In general, such detersive surfactants contain an alkyl group in the $C_{10}$–$C_{18}$ range; the anionic detersive surfactants are most commonly used in the form of their sodium, potassium or triethanolammonium salts; the nonionics generally contain from about 3 to about 17 ethylene oxide groups. U.S. Pat. Nos. 4,111,855 and 3,995,669 contain detailed listings of such typical detersive surfactants. $C_{12}$–$C_{16}$ alkyl benzene sulfonates, $C_{12}$–$C_{18}$ paraffin-sulfonates and the ethoxylated alcohols are especially preferred in the compositions of the present type.

The surfactant component can comprise as little as 0.1% of the compositions herein when formulated as a spray-on type product. When formulated as standard liquid cleaners, the compositions herein generally will contain about 1% to about 20%, preferably 2% to about 8%, of surfactant.

Optional Ingredients—The compositions herein can contain other ingredients which aid in their cleaning performance. For example, it is highly preferred that the compositions contain a detergent builder and/or metal ion sequestrant. Compounds classifiable and well-known in the art as detergent builders include the nitrilotriacetates, polycarboxylates, citrates, water-soluble phosphates such as tri-polyphosphate and sodium ortho- and pyro-phosphates, silicates, and mixtures thereof. Metal ion sequestrants include all of the above, plus materials like ethylenediaminetetraacetate, the amino-polyphosphonates and phosphates (DEQUEST) and a wide variety of other poly-functional organic acids and salts too numerous to mention in detail here. See U.S. Pat. No. 3,579,454 for typical examples of the use of such materials in various cleaning compositions. In general, the builder/sequestrant will comprise about 1% to 25% of the composition.

Soaps—As mentioned hereinabove, one special problem associated with the use of liquid cleansers is their tendency to over-suds, in-use. It has been discovered that soaps, especially the alkali, ammonium and alkanolammonium salts of $C_{13}$–$C_{24}$ fatty acids, are especially useful as suds suppressors when conjointly present with terpenes and benzyl alcohol in the instant compositions. Soap concentrations of at least about 0.005%, preferably 0.05% to 2%, provide this important suds control function. Soap prepared from coconut oil fatty acids is preferred.

Thickeners—The compositions herein may optionally be thickened. Thickened compositions tend to cling to vertical surfaces such as walls and windows, which makes them more convenient to use. Common thickeners such as the polyacrylates, xanthan gums, carboxymethyl celluloses, swellable smectite clays, and the like, can be used herein. Typically such materials are employed at 0.01%, or higher, depending on the desires of the formulator.

Moreover, the compositions herein can contain, in addition to ingredients already mentioned, various optional ingredients typically used in commercial products to provide aesthetic or additional product performance benefits. Typical ingredients include pH regulants, perfumes, dyes, optical brighteners, soil suspending agents, detersive enzymes, gel-control agents, freeze-thaw stabilizers, bactericides, preservatives, and the like.

Another additional ingredient for use herein is represented by conventional detergent hydrotropes. Examples of suitable hydrotropes are urea, monoethanolamine, diethanolamine, triethanolamine and the sodium, potassium, ammonium and alkanol ammonium salts of xylene-, toluene-, ethylbenzene- and isopropyl-benzene sulfonates. These hydrotropes can be added to the compositions of the present invention in amounts up to about 10% by weight. It is a particular feature of the present invention, however, that stable formulations can be prepared without the need for hydrotropic materials of this kind, or with only very minor levels such as amount of from 0 to 4% (up to 4%) by weight.

The compositions herein typically contain up to about 90% water as a carrier. Water-alcohol (e.g., ethanol, isopropanol, butanol, etc.) mixtures can also be used. Alkylated polysaccharides can be used to increase the stability and performance characteristics of the compositions.

The compositions herein are preferably formulated in the alkaline pH range, generally in the range of pH 8–11, preferably about 10–10.8. Caustics such as sodium hydroxide and sodium carbonate can be used to adjust and buffer the pH, as desired.

Since the compositions herein are in liquid form, they can be prepared by simply blending the essential and optional ingredients in the aqueous carrier.

The following examples are given by way of illustrating the compositions herein, but are not intended to be limiting of the scope of the invention.

ABBREVIATIONS

PS: Sodium $C_{13}$ to $C_{16}$ paraffin sulfonate
LAS: Sodium salt of linear $C_{11.8}$ alkyl benzene sulfonate
$AE_3S$: Sodium linear $C_{12-14}$ alcohol sulfate including 3 mole/mole ethylene oxide
Lutensol AO7: Condensate of 1 mole $C_{12}$–$C_{14}$ fatty alcohol with 7 moles of ethylene oxide
ESB: $C_{12}$–$C_{14}$ alkylpolysaccharide having the formula $C_{12}$–$C_{14}$—O—$(Z)_{2-2,4}$ wherein Z is a reducing saccharide moiety
Dobanol 91-8: $C_{9-11}$ oxoalcohol with 8 moles of ethylene oxide per mole of alcohol
HCNFA: Narrow cut, hardened, coconut fatty acid
STPP: Sodium tripolyphosphate
NTA: Sodium nitrilotriacetate
TSPP: Tetrasodium pyrophosphate
Polyacrylic Acid: MW about 1.5 million (water swellable)
Sodium Silicate: $Na_2O:xSiO_2$ ($x=3$–5)
PAA: Polyacrylic acid MW 5000–50000 (water-soluble)

Liquid cleansers were prepared by mixing the listed ingredients in the stated proportion.

| INGREDIENT | EXAMPLES I | II | A |
|---|---|---|---|
| PS | 2.5 | 2.5 | 2.5 |
| Lutensol AO7 | 0.5 | 0.5 | 0.5 |
| HCNFA | 0.3 | 0.3 | 0.3 |
| Sodium citrate | 3.3 | 3.3 | 3.3 |
| Sodium carbonate | 3.0 | 3.0 | 3.0 |
| Orange terpenes | 2.1 | 2.1 | 2.1 |
| Butyl Carbitol | — | — | 1.5 |
| Benzylalcohol | 1.5 | 1.5 | — |
| Polyacrylic Acid | 0.75 | 0.75 | 0.75 |
| Diatomaceous earth* | 25 | — | — |
| Calcium carbonate** | — | 25 | — |
| Zeolite A*** | — | — | 25 |

*Celite 499 from Johns-Manville
Median particle size: 8–12 microns
**Merck 2066
Median particle size: 10 microns
***$Na_{12}(AlO_2.SiO_2)_{12}.27H_2O$
Median particle size: 8 microns The above compositions were comparatively tested on synthetic soils representative of typical hard surface household soils. The test-soils were prepared as follows.

(a) HBTS soil: is composed of 250 ml isopropyl alcohol, 75 g. calcium stearate powder and 0.5 g. carbon black. It is applied on an enamel-coated metal plate (cleaned with a detergent and then with alcohol) with a paint roller, and the plates are baked at 180° C. for 20 minutes.

(b) KD soil: is composed of 25% HSW® soil with carbon black (2), 37.5% Crisco® (1) oil, 37.5% Puritan® (1) oil. This soil is rolled onto stainless steel plates (beforehand cleaned with a detergent and then with alcohol) using a paint roller. A very thin uniform layer is needed since the soil is difficult to cure. The plates are placed in the oven at 115° C. for 2 hours and then allowed to age at least 1 day.

(c) Black shoe polish: is spread on a PVC tile (degreased with a detergent and then with alcohol) with a paint roller. The tile can be used after 1 day drying at room temperature.

(d) German soil: is composed of 48% Johnson Cristalin® Wax, 48% water and 4% carbon black. It is applied on a PVC tile (degreased with a detergent and then with alcohol) with a paint roller. The tile can be used after 1 day drying at room temperature.

(1) commercial cooking oils sold by the Procter & Gamble Company.

(2) commercial soil sold by Chem Pack Inc., USA.

The testing conditions were as follows:

All tests were run with the aid of an Erichsen washability machine. A sponge of approximately 9.5×5×4 cm was used after being carefully washed under hot running water and squeezed through drying rolls. 5 g. of the undiluted cleanser to be tested was spread over one side of the sponge. The number of strokes of the cleaning machine varied with the type of soil. Performance readings were done as soon as visible cleaning differences became noticeable. The gradings were done visually be three judges working independently. The performance benefits were established via a paired comparison with duplicates as follows. A 0–4 scale was used whereby: 0 means no difference; 1=probable difference; 2=consistent difference; 3=clear difference; 4=big difference.

The testing results were as listed below. Prior art composition A was the reference against which compositions I and II were compared.

| Soil | Example II | vs. | Composition A | LSD |
|---|---|---|---|---|
| KD | +1,30 | | −1,30 | 0,91 |
| HBTS | +1,13 | | −1,13 | 1,10 |
| **Soil** | **Example I** | **vs.** | **Composition A** | **LSD** |
| Shoe polish | +1,01 | | −1,01 | 0,34 |
| German | +0,84 | | −0,84 | 1,45 |
| HBTS | +0,88 | | −0,88 | 0,94 |

The above test clearly confirms the significant performance benefits derivable from the inventive compositions vs. closely related art compositions.

| | EXAMPLES | | | | | | | | | | | | |
|---|---|---|---|---|---|---|---|---|---|---|---|---|---|
| | III | IV | V | VI | VII | VIII | IX | X | XI | XII | XIII | XIV | XV |
| PS | 2.5 | — | — | — | 2.5 | — | — | — | 2.0 | — | — | — | — |
| LAS | — | 2.5 | — | — | — | 2.5 | — | — | — | 2.0 | — | 2.5 | 2.5 |
| $AE_3S$ | — | — | 2.5 | — | — | — | 2.5 | — | — | — | 2.0 | — | — |
| Lutensol AO7 | — | 0.5 | — | — | — | — | 1.0 | 0.5 | 0.5 | — | — | 1.0 | 1.0 |
| ESB | — | — | 0.5 | 3.0 | 0.5 | — | — | 2.5 | — | 1.0 | — | — | — |
| Dobanol 91-8 | 0.5 | — | — | 0.5 | — | 0.5 | — | — | 0.5 | — | 0.75 | — | — |
| HCNFA | 0.3 | 0.3 | 0.2 | 0.1 | 0.3 | 0.3 | 0.2 | 0.1 | 0.3 | 0.2 | 0.2 | 0.2 | 0.2 |
| Sodium silicate | — | — | — | — | 3.0 | — | 3.0 | 3.0 | — | — | — | — | — |
| Sodium carbonate | 3.0 | 2.0 | 3.0 | 2.0 | — | — | — | — | 3.0 | — | — | 3.0 | 1.0 |
| Sodium citrate | 3.3 | — | — | — | — | — | — | — | 3.3 | — | — | — | — |
| STPP | — | 2.0 | — | — | — | — | — | 5.0 | — | — | 3.5 | — | — |
| NTA | — | — | 2.0 | — | — | — | 5.0 | — | — | — | — | — | — |
| TSPP | — | — | — | 2.0 | — | 5.0 | — | — | — | 3.5 | — | 5.0 | — |
| PAA | — | — | — | — | 3.5 | — | — | — | 1.0 | — | — | — | — |
| Terpenes | 4.2 | 2.1 | 2.1 | 4.2 | 2.1 | 2.1 | 3.1 | 3.1 | 2.1 | 2.1 | 3.1 | 4.2 | 2.1 |
| Benzylalcohol | 3.0 | 1.5 | 1.5 | 3.0 | 1.5 | 1.5 | 2.2 | 2.2 | 1.5 | 1.5 | 2.2 | 3.0 | 1.5 |
| Propanol | — | — | — | 2.5 | — | — | — | 2.5 | — | — | — | 1.0 | — |
| Diatomaceous earth | — | — | — | 12.5 | 12.5 | 12.5 | — | — | — | 25 | 5 | — | — |
| Calcium carbonate | 20 | 20 | 20 | — | — | — | 30 | 30 | 30 | — | 20 | — | — |
| Abrasive polymers | — | — | — | — | — | — | — | — | — | — | — | 40 | 40 |
| EDTA | — | — | — | — | — | — | — | — | — | — | — | — | 2.5 |
| Natural gums | — | — | — | 1.0 | 1.0 | 1.0 | — | — | — | 1.5 | 1.5 | — | — |
| Polyacrylic Acid | 0.75 | 0.75 | 0.75 | — | — | — | 0.5 | 1.0 | 0.75 | — | — | 1.0 | 1.0 |
| Water, perfume & Minors | | | | | | | to 100% | | | | | | |

As can been seen from the foregoing, the present invention encompasses a variety of formulations which contain solvent systems and abrasives, together with conventional cleaning agents and aids. It has been discovered that polymerized organic abrasives are preferred over calcium- or magnesium-based abrasives in liquid compositions which contain metal ion sequestrants or chelators such as EDTA, nitrilotriacetate, and the like. It has further been discovered that certain organic polymers not generally thought of as abrasives can be formulated in powdered form into the present compositions to provide abrasive benefits, while being safe not only towards surfaces such as porcelain and stainless steel, but also plastic surfaces.

Included among such polymers are polyvinyl chloride (preferred), polyacrylate and polyethylene. Importantly, since such polymers do not contain calcium, they exhibit long-term storage stability when used in combination with metal ion sequestrants and chelators.

An example of a liquid cleanser with PVC abrasive is as follows:

EXAMPLE XVI

| Ingredient | Percent |
|---|---|
| Tripotassium Pyrophosphate | 3.0 |
| EDTA | 3.0 |
| Polyvinyl Chloride | 30.0 |
| Benzyl Alcohol | 4.2 |
| Orange Terpene | 2.0 |
| $C_{11-12}$ Alkyl Benzene Sulfonate | 6.0 |
| $C_{14-15}$ Ethoxylate (EO 7) | 0.7 |
| Perfume, color, minors | 1.0 |
| Water to | 100% |

It has further been discovered that an acceptably-performing product can be formulated using Butyl Carbitol (2-(2-butoxyethoxy)ethanol) in place of benzyl alcohol, particularly if alkyl benzene sulfonate is used therein as a detersive surfactant.

I claim:

1. An aqueous liquid scouring cleanser composition comprising at least 0.1% by weight terpene or terpene derivative, at least 0.1% by weight benzyl alcohol, from 1–50% by weight of a water-insoluble abrasive having a Mohs hardness of 3, or below, the abrasive being selected from calcium carbonate, diatomaceous earth and polyvinyl chloride; and mixtures thereof; said abrasive having a particle size of from about 5 to about 150 microns; wherein said composition in addition contains from 1% to 20% by weight of a detersive surfactant selected from ethoxylated alcohols, alkyl benzene sulfonates, paraffin sulfonates, and mixtures thereof.

2. The composition in accordance with claim 1 wherein the terpene is selected from d-limonene, dipentene, alpha-pinene and beta-pinene, and mixtures thereof, and is present at a concentration of 0.5–10%.

3. The composition in accordance with claim 1 wherein the terpene derivative is a terpene alcohol, terpene aldehyde, terpene ester, or terpene ketone, or mixture thereof, and is present at a concentration of 0.5–10%.

4. The composition in accordance with claim 1 wherein the benzyl alcohol is present at a concentration of from 0.5–10%.

5. The composition in accordance with claim 1 wherein the weight ratio of terpene or terpene derivative to benzyl alcohol is in the range from 5:1 to 1:5.

6. A composition in accordance with claim 1 which also contains a sequestrant selected from the water-soluble salts of polyphosphates, silicates, polycarboxylates, nitrilotracetates, citrates, amino polycarboxylates, polyphosphonates and aminopolyphosphonates.

7. A composition according to claim 1 which comprises from 15–30% by weight of said abrasive.

8. A composition according to claim 1 which comprises:

(a) 0.5–10% orange terpenes;
(b) 0.5–10% benzyl alcohol;
(c) 20–25% abrasive;
(d) 2–8% surfactant selected from mixtures of paraffin sulfonate or alkyl benzene sulfonate with an ethoxylated $C_{10}$–$C_{18}$ alcohol;
(e) the balance of the composition comprising an aqueous carrier, conventional detergency builders, perfumes and the like.

9. The composition of claim 1 or 8 wherein said composition contains a thickener selected from the group consisting of polyacrylates, xanthan gums, carboxymethyl celluloses, swellable smectite clays, and mixtures thereof.

* * * * *